US005642531A

United States Patent [19]

Holtom et al.

[11] Patent Number: 5,642,531

[45] Date of Patent: Jul. 1, 1997

[54] METHOD OF WARMING A TOILET SEAT

[76] Inventors: Anna Marie Holtom, #18, 4516 - 48 Avenue, Sylvan Lake, Alberta, Canada, T4S 1L8; James A. Holtom, Box 9074, Sylvan Lake, Canada, T4S 1S6; Darin L. Holtom, #32 4402 - 48 Ave, Sylvan Lake, Alberta, Canada, T4S 1N7

[21] Appl. No.: 608,606

[22] Filed: Feb. 29, 1996

[51] Int. Cl.[6] ..... A47K 13/30

[52] U.S. Cl. ..... 4/237; 4/233; 4/234; 4/661; 4/DIG. 6

[58] Field of Search ..... 4/237, 234, 233, 4/DIG. 6, 661

[56] References Cited

U.S. PATENT DOCUMENTS

| | | | |
|---|---|---|---|
| 2,592,167 | 4/1952 | Monaghan | 4/233 |
| 5,119,517 | 6/1992 | Chang | 4/233 |
| 5,307,524 | 5/1994 | Veal | 4/246.1 |

FOREIGN PATENT DOCUMENTS

| | | | |
|---|---|---|---|
| 4-84916 | 3/1992 | Japan | 4/233 |
| 4-84915 | 3/1992 | Japan | 4/233 |

*Primary Examiner*—Henry J. Recla
*Assistant Examiner*—Charles R. Eloshway
*Attorney, Agent, or Firm*—Anthony R. Lambert

[57] ABSTRACT

A method of warming a toilet seat is described. Firstly, provide a toilet having a toilet seat and a pivotally mounted toilet seat cover. The toilet seat cover has a lower surface and a peripheral edge. The toilet seat cover is pivotally movable between a substantially vertical raised position and a substantially horizontal lowered position in which the lower surface of the toilet seat cover overlies the toilet seat. Secondly, secure a string of low voltage lights to the lower surface of the toilet seat cover adjacent the peripheral edge. Thirdly, position the toilet seat cover in a pivotal position parallel to the toilet seat when the toilet seat is not in use. Heat generated by the low voltage lights in proximity to the toilet seat warms the toilet seat in preparation for use.

1 Claim, 2 Drawing Sheets

METHOD OF WARMING A TOILET SEAT

FIELD OF THE INVENTION

The present invention relates to a method of warming a toilet seat to make it more comfortable to persons having to seat themselves on the toilet seat in order to use a toilet.

BACKGROUND OF THE INVENTION

U.S. Pat. No. 802,106 which issued to Mattheson in 1905, U.S. Pat. No. 929,079 which issued to Cresse in 1909 and U.S. Pat. No. 1,839,156 which issued to Lumpkin in 1931 all disclose toilet seat warming apparatus. The method of warming the toilet seat common to all three patents is by circulating hot water through the toilet seat. The purpose of such apparatus, as described in the Cresse reference, was to shield the user from "the discomfort and shock commonly experienced by using toilet seats in cold weather".

Although construction methods and residential heating systems have vastly improved during the intervening years, the problem is still with us; albeit to a lesser degree.

SUMMARY OF THE INVENTION

What is required is a method of warming a toilet seat to make it more comfortable for the user.

According to one aspect of the present invention there is provided a method of warming a toilet seat. Firstly, provide a toilet having a toilet seat and a pivotally mounted toilet seat cover. The toilet seat cover has a lower surface and a peripheral edge. The toilet seat cover is pivotally movable between a substantially vertical raised position and a substantially horizontal lowered position in which the lower surface of the toilet seat cover overlies the toilet seat. Secondly, secure a string of low voltage lights to the lower surface of the toilet seat cover adjacent the peripheral edge. Thirdly, position the toilet seat cover in a pivotal position parallel to the toilet seat when the toilet seat is not in use. The low voltage lights are in close proximity to the toilet seat when the toilet seat cover is parallel to the toilet seat such that heat generated by the low voltage lights warm the toilet seat in preparation for use.

With the method, as described above, the toilet seat is always warm and ready for use a result of heat generated from the low voltage lights. The lights do not in any way interfere with the use of the toilet seat, however, as they pivot away from the toilet seat with the toilet seat cover when the toilet seat cover is lifted. It will be appreciated that the toilet seat cover and the toilet seat need only be maintained in parallel relation for the lights to perform their desired function of heating the seat. The desired result can, therefore, be obtained by either having both the toilet seat cover and the toilet seat in the raised position or both the toilet seat cover and the toilet seat in the lowered position. A secondary benefit obtained from the use of the method, as described above, is that the light generated from the lights assists in locating the toilet in the dark. This is true whether the toilet seat cover is in the raised position or the lowered position.

According to another aspect of the present invention there is provided a combination which includes a toilet having a toilet seat and a pivotally mounted toilet seat cover. The pivotally mounted toilet seat cover has a lower surface and a peripheral edge. The toilet seat cover is pivotally movable between a substantially vertical raised position and a substantially horizontal lowered position in which the lower surface of the toilet seat cover overlies the toilet seat. A string of low voltage lights is secured to the lower surface of the toilet seat cover adjacent the peripheral edge. When the toilet seat cover is parallel to the toilet seat, the low voltage lights are in close proximity to the toilet seat and preheat the toilet seat in preparation for use.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The steps involved in the preferred method of warming a toilet seat will now be described with reference to FIGS. 1 and 2.

Figure 1:
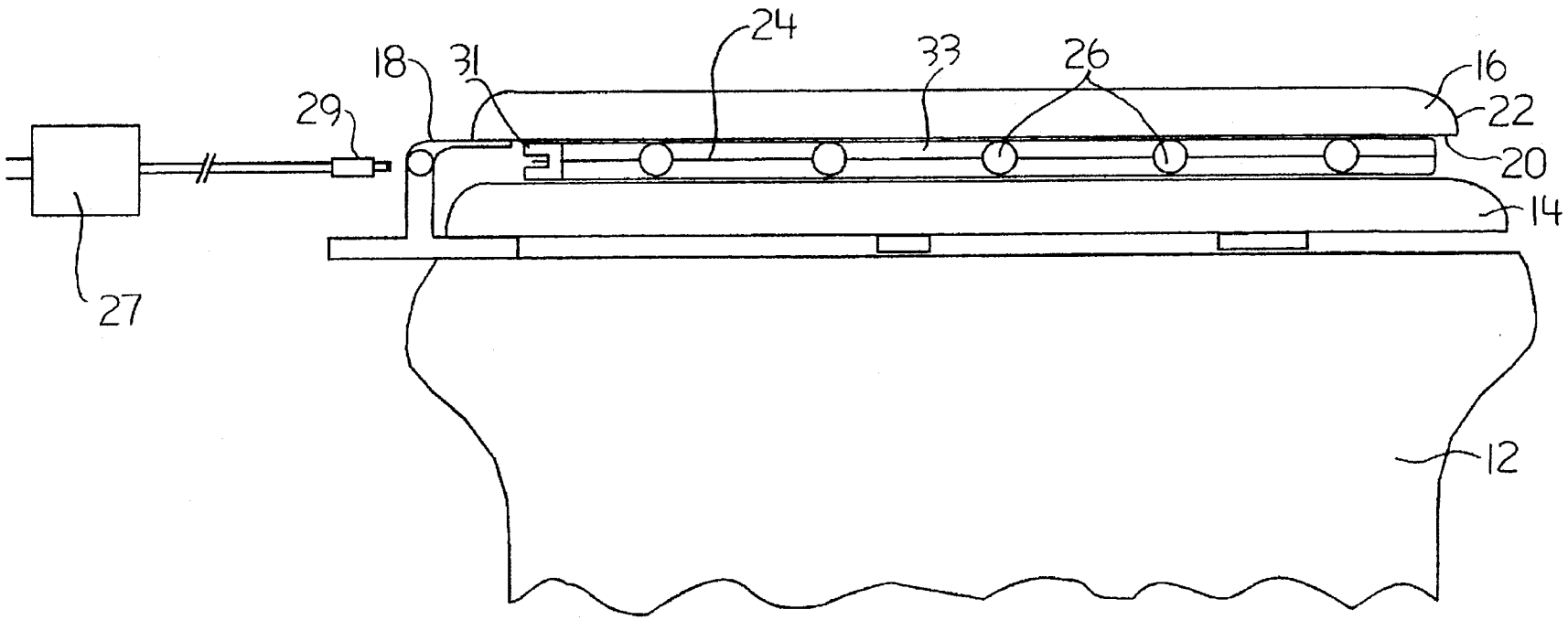
FIG. 1 is a side elevation view of a toilet seat and toilet seat cover equipped with low voltage lights in accordance with the teachings of the invention.
Figure 2:
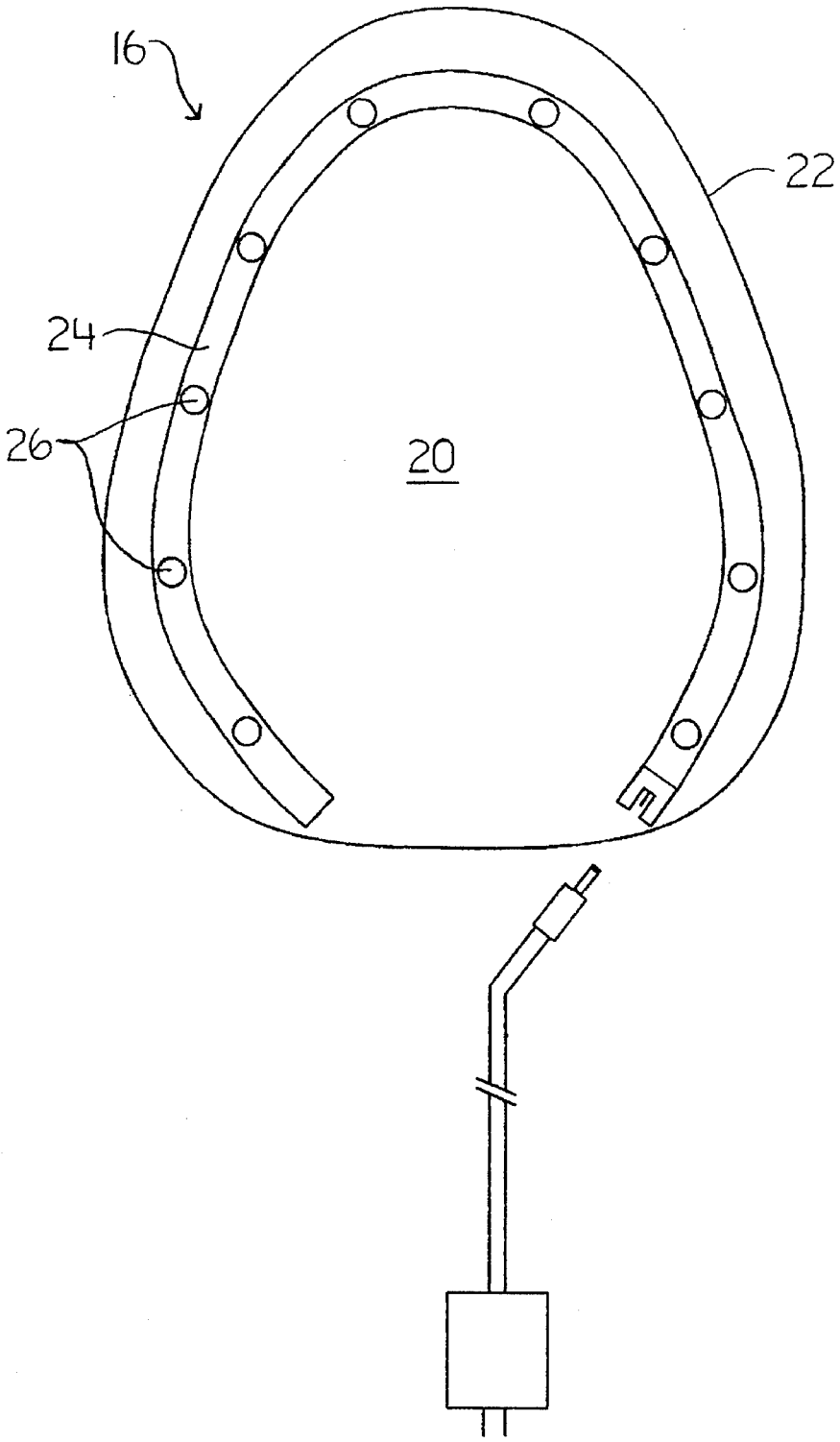
FIG. 2 is front elevation view of the toilet seat cover illustrated in FIG. 1, the toilet seat cover being in a raised position.

Firstly, provide a toilet 12 having a toilet seat 14 and a pivotally mounted toilet seat cover 16, as illustrated in FIG. 1. The pivotal mounting is provided by hinge 18. Toilet seat cover 16 has a lower surface 20 and a peripheral edge 22. It is pivotally movable between a substantially vertical raised position, as illustrated in FIG. 2, and a substantially horizontal lowered position, as illustrated in FIG. 1. Referring to FIG. 1, in the lowered position, lower surface 20 of toilet seat cover 16 overlies toilet seat 14. Secondly, secure a string 24 of low voltage lights 26 to lower surface 20 of toilet seat cover 16 adjacent peripheral edge 22, as illustrated in FIG. 2. For improved sanitation and to protect lights 26, it is preferred that the low voltage lights be enclosed in a clear plastic tubular casing 33. Beneficial results have been obtained through the use of 9 mm. by 8 mm. square tubular plastic for casing 33. Thirdly, pivot toilet seat cover 16 so it is parallel to toilet seat 14, when not in use. In FIG. 1, both toilet seat cover 16 and toilet seat 14 are illustrated in the lowered position. It will be appreciated that the desired parallel relationship can also be created by placing both in the raised position. When toilet seat cover 16 and toilet seat 14 are parallel, low voltage lights 26 are in close proximity to toilet seat 14. Heat is generated by low voltage lights 26 which warm toilet seat 14 in preparation for use.

Low Voltage power is supplied to string 24 of low voltage lights 26 by means of a commercially available low voltage transformer 27, that plugs into a conventional household power outlet. Beneficial results have been obtained using a low voltage power source that transforms conventional household power to a 16 volt/250 milli-amp output. Mating male/female connectors 29 and 31 connect low voltage transformer 27 with string 24 of lights 26. Lights 26 do not in any way interfere with the use of toilet seat 14. They pivot away from toilet seat 14 with toilet seat cover 16 when toilet seat cover 16 is moved to the raised position illustrated in FIG. 2. In addition, light generated from lights 26 provides a secondary function, by assisting the user to locate toilet 12 in the dark. This is equally true whether toilet seat cover 16 is in the raised position or the lowered position.

Another aspect of the present invention relates to a combination apparatus which includes toilet 12, toilet seat 14, toilet seat cover 16, and string 24 of low voltage lights 26 secured to lower surface 20 of toilet seat cover 16 adjacent peripheral edge 22. With the combination apparatus, when toilet seat cover 16 is pivoted parallel to toilet seat 14, low voltage lights 26 preheat toilet seat 14 in accordance with the teaching of the method.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of warming a toilet seat, comprising the steps of:

firstly, providing a toilet having a toilet seat and a pivotally mounted toilet seat cover having a lower surface and a peripheral edge, the toilet seat cover being pivotally movable between a substantially vertical raised position and a substantially horizontal lowered position in which the lower surface of the toilet seat cover overlies the toilet seat;

secondly, securing a string of low voltage lights to the lower surface of the toilet seat cover adjacent the peripheral edge;

thirdly, pivoting the toilet seat cover to a position parallel to the toilet seat when the toilet seat is not in use, such that the low voltage lights are in close proximity to the toilet seat; and fourthly, supplying low voltage to said lights continuously and non-intermittently such that heat generated by the low voltage lights warms the toilet seat continuously in preparation for use.

* * * * *